US009799948B2

(12) United States Patent
Rubin et al.

(10) Patent No.: US 9,799,948 B2
(45) Date of Patent: Oct. 24, 2017

(54) OPTICALLY TRANSMISSIVE ANTENNA BREAK STRUCTURES FOR WIRELESS DEVICES, AND ASSOCIATED SYSTEMS AND PROCESSES

(71) Applicant: Essential Products, Inc., Palo Alto, CA (US)

(72) Inventors: Andrew E. Rubin, Los Altos, CA (US); Matthew Hershenson, Los Altos, CA (US); David John Evans, V, Palo Alto, CA (US); Xinrui Jiang, San Jose, CA (US); Xiaoyu Miao, Palo Alto, CA (US)

(73) Assignee: ESSENTIAL PRODUCTS, INC., Palo Alto, CA (US)

( * ) Notice: Subject to any disclaimer, the term of this patent is extended or adjusted under 35 U.S.C. 154(b) by 0 days.

(21) Appl. No.: 15/336,742

(22) Filed: Oct. 27, 2016

(65) Prior Publication Data

US 2017/0125888 A1 May 4, 2017

Related U.S. Application Data

(60) Provisional application No. 62/249,130, filed on Oct. 30, 2015, provisional application No. 62/317,775, filed on Apr. 4, 2016.

(51) Int. Cl.

| | |
|---|---|
| ***H01Q 1/36*** | (2006.01) |
| ***H01Q 1/24*** | (2006.01) |
| ***H01Q 5/22*** | (2015.01) |
| ***H01Q 1/50*** | (2006.01) |

(52) U.S. Cl.

CPC ..... *H01Q 1/243* (2013.01); *H01Q 1/50* (2013.01); *H01Q 5/22* (2015.01)

(58) Field of Classification Search

CPC ..... H01Q 1/243; H01Q 1/36; H01Q 5/371; H01Q 5/40; H01Q 9/0407; H01Q 9/0421; H01Q 1/50

USPC ..... 343/702; 342/52, 54, 62

See application file for complete search history.

(56) References Cited

U.S. PATENT DOCUMENTS

| | | | | |
|---|---|---|---|---|
| 7,121,467 | B2 * | 10/2006 | Winter | G06K 7/0004 235/462.01 |
| 8,219,161 | B2 * | 7/2012 | Hiraoka | H01Q 1/1235 343/702 |
| 8,330,646 | B2 * | 12/2012 | Baumatz | G01S 7/48 342/52 |

(Continued)

FOREIGN PATENT DOCUMENTS

WO 03090384 A1 10/2003

*Primary Examiner* — Tho G Phan

(74) *Attorney, Agent, or Firm* — Perkins Coie LLP

(57) ABSTRACT

Disclosed are structures, methods and systems for wireless devices that are configured to allow the transmission of light through an enhanced antenna break for a wide variety of purposes. In an illustrative embodiment, an antenna break is configured to allow the passage of both wireless communication signals and light, such as to notify the user of one or more conditions. The light transmission can be integrated with other functions of the wireless device, such as to provide a flash for operation of a camera, to provide a light source for scanning or 3D sensing, to provide light in conjunction to acoustic or vibration output, or to sense light for other integrated functions.

25 Claims, 13 Drawing Sheets

(56) References Cited

U.S. PATENT DOCUMENTS

| | | | | |
|---|---|---|---|---|
| 8,576,572 | B2 * | 11/2013 | Tanaka | H01Q 1/243 361/748 |
| 2006/0279732 | A1 | 12/2006 | Wang et al. | |
| 2008/0297469 | A1 | 12/2008 | Drader et al. | |
| 2009/0184942 | A1 | 7/2009 | Wong et al. | |
| 2012/0194998 | A1 | 8/2012 | McClure et al. | |
| 2012/0214412 | A1 | 8/2012 | Schlub et al. | |
| 2012/0295665 | A1 | 11/2012 | Pantfoerder | |
| 2013/0027892 | A1 | 1/2013 | Lim et al. | |
| 2014/0104116 | A1 * | 4/2014 | Chiu | H01Q 1/24 343/702 |
| 2014/0111684 | A1 * | 4/2014 | Corbin | H01Q 1/243 348/374 |
| 2014/0139379 | A1 | 5/2014 | Bolin et al. | |
| 2014/0171929 | A1 | 6/2014 | Weckwerth et al. | |
| 2014/0240176 | A1 | 8/2014 | Tolbert et al. | |

* cited by examiner

OPTICALLY TRANSMISSIVE ANTENNA BREAK STRUCTURES FOR WIRELESS DEVICES, AND ASSOCIATED SYSTEMS AND PROCESSES

CROSS REFERENCE TO RELATED APPLICATIONS

This Application claims priority to and the benefit of U.S. Provisional Application No. 62/249,130, filed Oct. 30, 2015 and U.S. Provisional Application No. 62/317,775, filed Apr. 4, 2016, which are incorporated herein in their entireties by this reference thereto.

FIELD OF THE INVENTION

At least one embodiment of the present invention pertains to an antenna break for an enclosure of a wireless device, in which the antenna break is optically transmissive. More particularly, at least one embodiment of the present invention pertains to an antenna break for a wireless device, in which light can pass therethrough to provide any of display or sensing functions.

BACKGROUND

Wireless devices such as mobile phones often include a metal casing or enclosure. However, such devices also include an antenna for sending and receiving wireless signals. The form factor for most current wireless devices requires that the antenna be located within the interior region of the casing or enclosure. However, the use of an all-metal casing for a device that includes an internal antenna often results unacceptable attenuation or loss of wireless signals.

Non-metallic antenna breaks have been developed and implemented for wireless devices, which are integrated with the casing or enclosure, to improve the transmission and reception of wireless radio signals. Efforts have been made to make such breaks aesthetically pleasing, such as to be flush with respect to adjoining surfaces of the casing, and often comprise an opaque thermoplastic structure.

Other functions related to the mobile device, such as displays, lighting, cameras, user interfaces, and/or flash units, are often implemented at other locations in either the casing or a front display surface.

BRIEF DESCRIPTION OF THE DRAWINGS

One or more embodiments of the present invention are illustrated by way of example and not limitation in the figures of the accompanying drawings, in which like references indicate similar elements.

DETAILED DESCRIPTION

References in this description to "an embodiment", "one embodiment", or the like, mean that the particular feature, function, structure or characteristic being described is included in at least one embodiment of the present invention. Occurrences of such phrases in this specification do not necessarily all refer to the same embodiment. On the other hand, the embodiments referred to also are not necessarily mutually exclusive.

Introduced here are enhanced antenna break structures for wireless devices that can be used for the transmission and/or reception of light, such as to display notifications for a user, or for integration with other device functions.

In certain embodiments, the enhanced antenna break structures can be transparent or translucent, and can be tinted or colored.

In certain embodiments, a light source includes one or more light emitting diodes (LEDs) or laser diodes (LDs).

In certain embodiments, an enhanced light source is combined with an optical diffuser and/or other reflective or refractive elements.

In certain embodiments, an enhanced light source can operate as a flash unit, such as in conjunction with an integrated camera unit.

In certain embodiments, the enhanced light source can operate in conjunction with a sensor, such as to provide any of user controls, e.g., power and/or volume, fingerprint sensing, ambient light sensing, proximity sensing, an optical trackpad, or a heart rate sensor.

In certain embodiments, the enhanced light effects can provide notifications, which can further provide output based on priority. Such lighting effects can include functions such as any of off/on, flashing, or varied intensities, e.g., sinusoidal light intensity at one location, e.g., a light position, or at more than one locations, e.g., a standing or traveling light wave projected from a light pipe.

Figure 1:
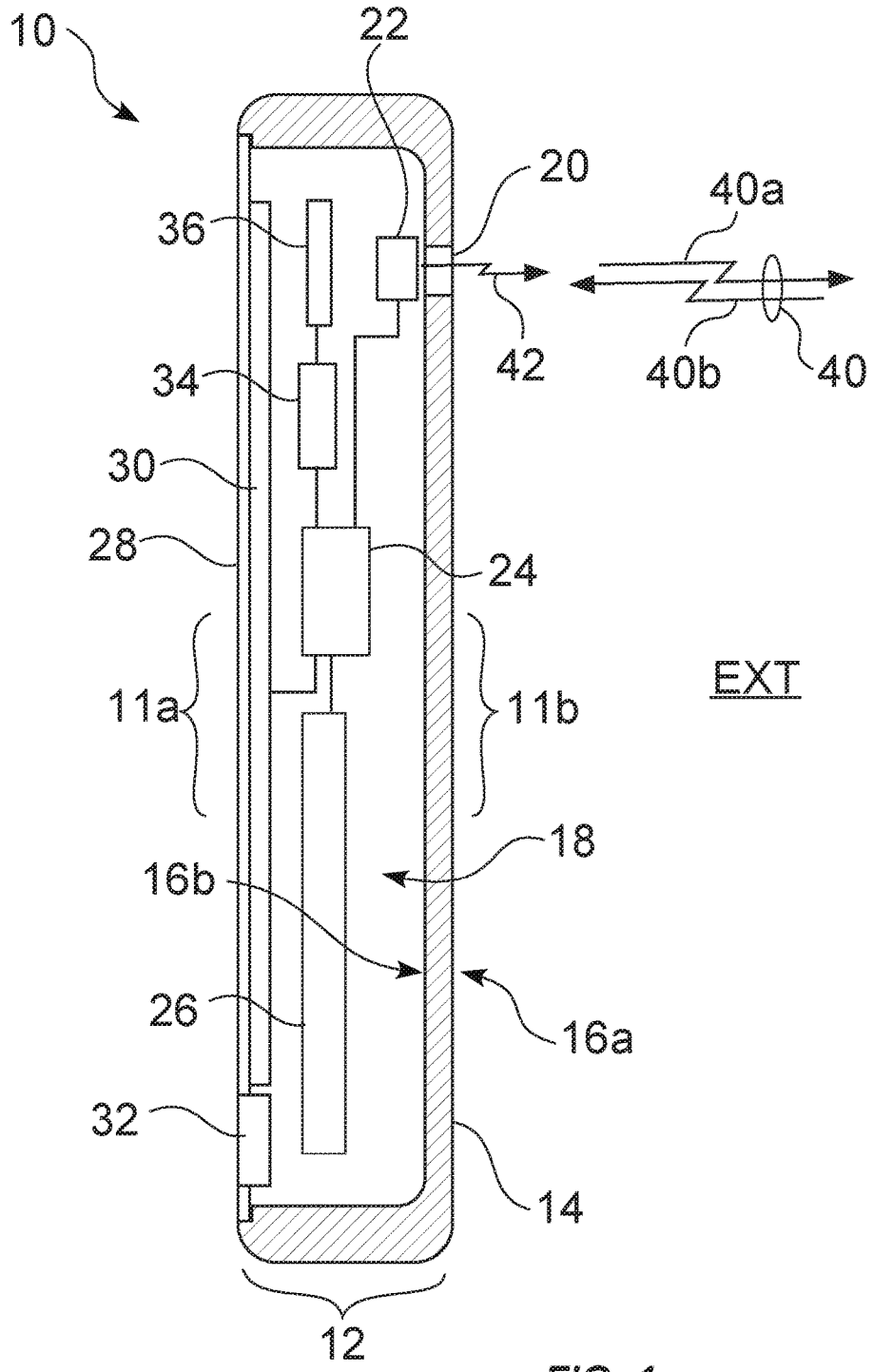
FIG. 1 is a partial cutaway view of an illustrative wireless device having an antenna break that is configured for the transmission of light therethrough.

FIG. 1 is a simplified partial cutaway view 10 of an illustrative wireless device 12 having an antenna break 20 that is configured for the transmission of light 42 therethrough. The illustrative wireless device 12 seen in FIG. 1 includes a housing 14 having an exterior surface 16*a* and an interior surface 16*b* opposite the exterior surface 16*a*, wherein the exterior surface 16*a* faces the rear side 11*b* of the wireless device 12 toward the exterior environment EXT. The front side 11*a* of the illustrative wireless device 12 seen in FIG. 1 can include an outer panel 28, e.g., glass or polymer, a display 30, and/or home button or other input device 32. An interior region 18 is defined within the wireless device 12, wherein component assemblies are located, such as including a processor 24, a power source 26, a transceiver 34 and a corresponding antenna 36 through which wireless signals 40 are sent and received.

The illustrative housing 14 seen in FIG. 1 includes an antenna break 20 that extends from the interior region 18 and through the housing 14 to the exterior region EXT. The antenna break 20 is configured to allow an outgoing wireless signal 40*a* to be transmitted from the antenna 36 to the exterior EXT, and to allow an incoming wireless signal 40*b* to be received at the antenna 36 from the exterior EXT. The antenna break 20 can define one or more non-metallic or electrically insulative regions.

The antenna break 20 seen in FIG. 1 is also configured to be optically transmissive, such that light 42 from an internal light source 22 can be transmitted from the interior region 18 through the antenna break 20 at least to the exterior surface 16*a* of the housing 14, such as for any of a display function or a sensing function. In some embodiments, the enhanced antenna break 20 is transparent or translucent, and can be clear, tinted or colored, such as based on its intended function. In some embodiments of the wireless device 12, the antenna break 20 is configured to transmit incoming light 42*b* (FIG. 16) therethrough, such as to be received by a sensor, e.g., 110 (FIG. 5), 508 (FIG. 14) or by a camera, e.g., 62 (FIGS. 2,3).

Figure 2:
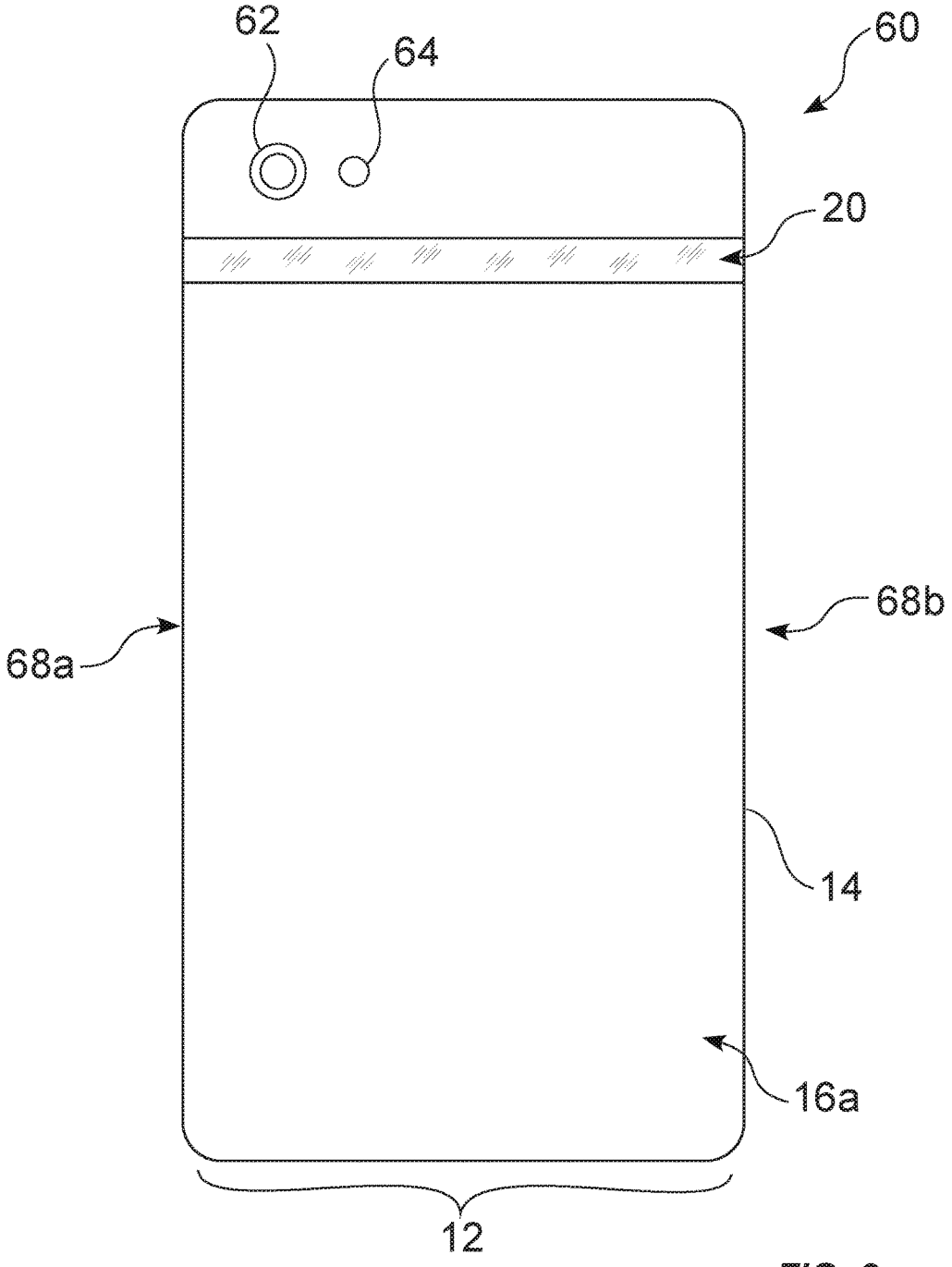
FIG. 2 is a schematic view of an illustrative housing for a wireless device having an enhanced antenna break that allows the passage of light.
Figure 3:
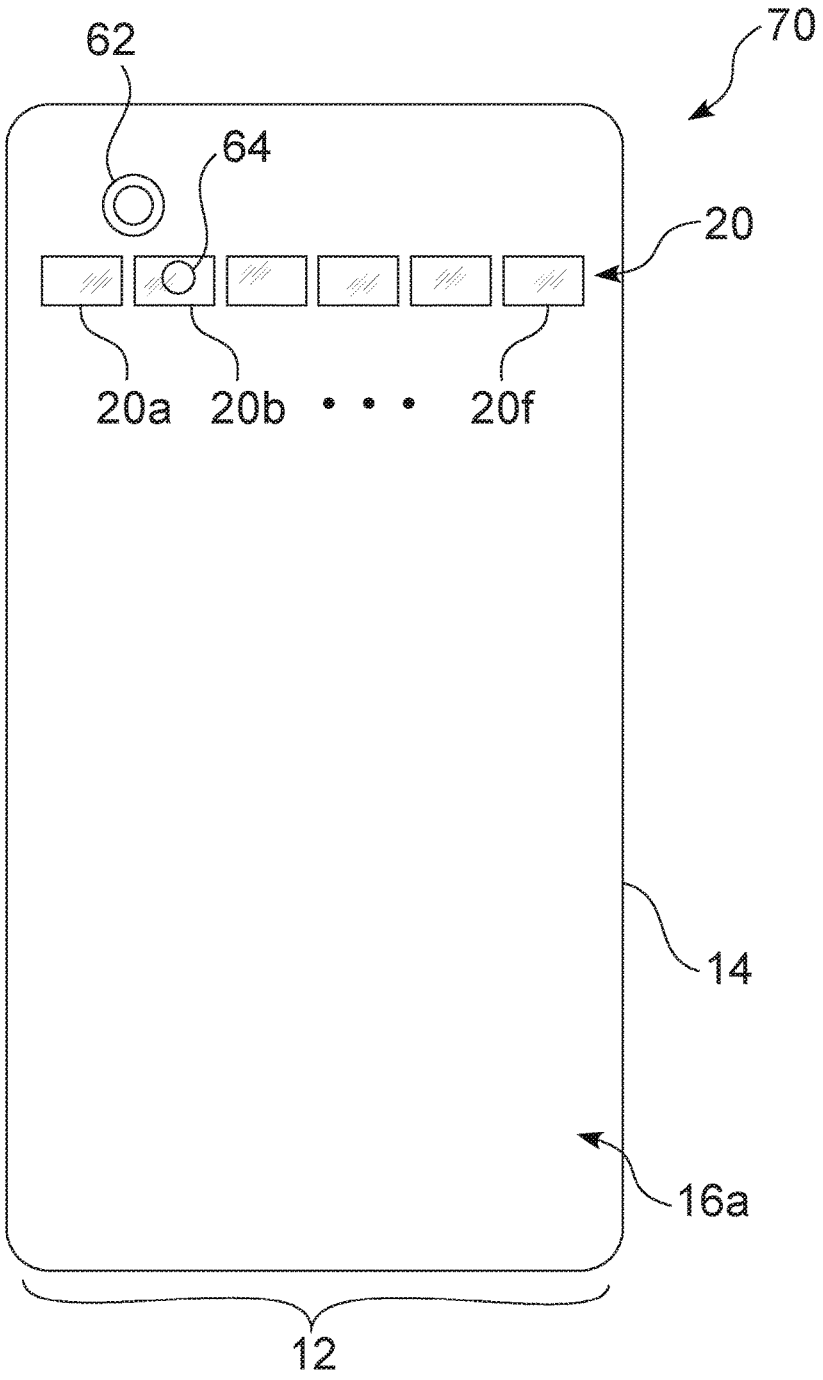
FIG. 3 is a schematic view of an illustrative housing for a wireless device having an alternate enhanced antenna break that allows the passage of light.

FIG. 2 is a schematic view 60 of an illustrative housing 14 for a wireless device 12 having an enhanced antenna break 20 that allows the passage of light 42. FIG. 3 is a schematic view 70 of an illustrative housing 14 for a wireless device having an alternate enhanced antenna break 20 that allows the passage of light 42. As seen in FIG. 2 and FIG. 3, the antenna break 20 can include one or more antenna break portions 20*a*-20*f* across the housing 14, such as based on any of design or intended purpose for optical functions. As seen in FIG. 3, a light source 22 can function as a flash 64 for an integrated camera 62.

Figure 4:
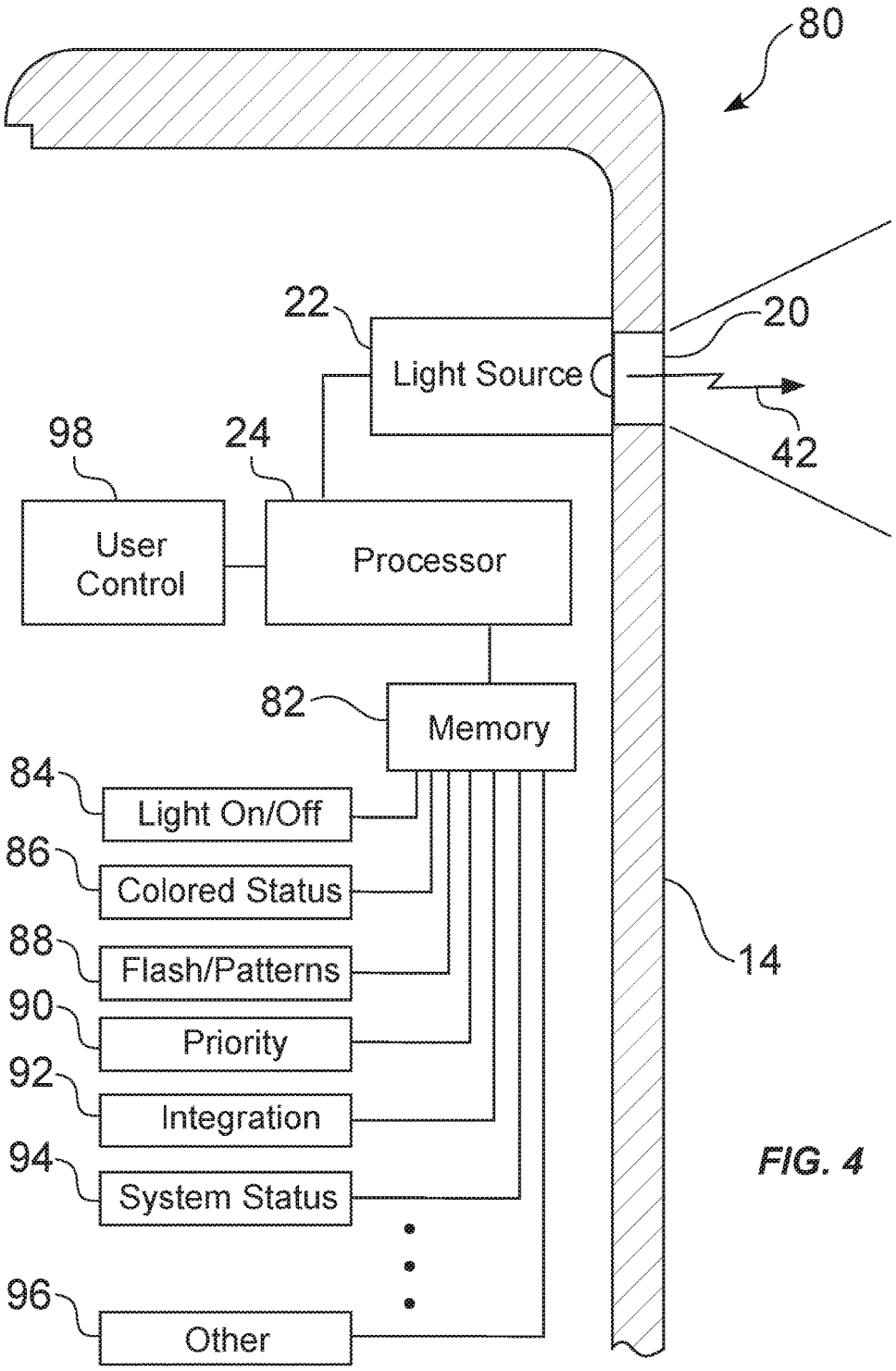
FIG. 4 is partial detailed schematic cutaway view of a wireless device having an enhanced antenna break and controlled emission of light based on one or more factors.
Figure 14:
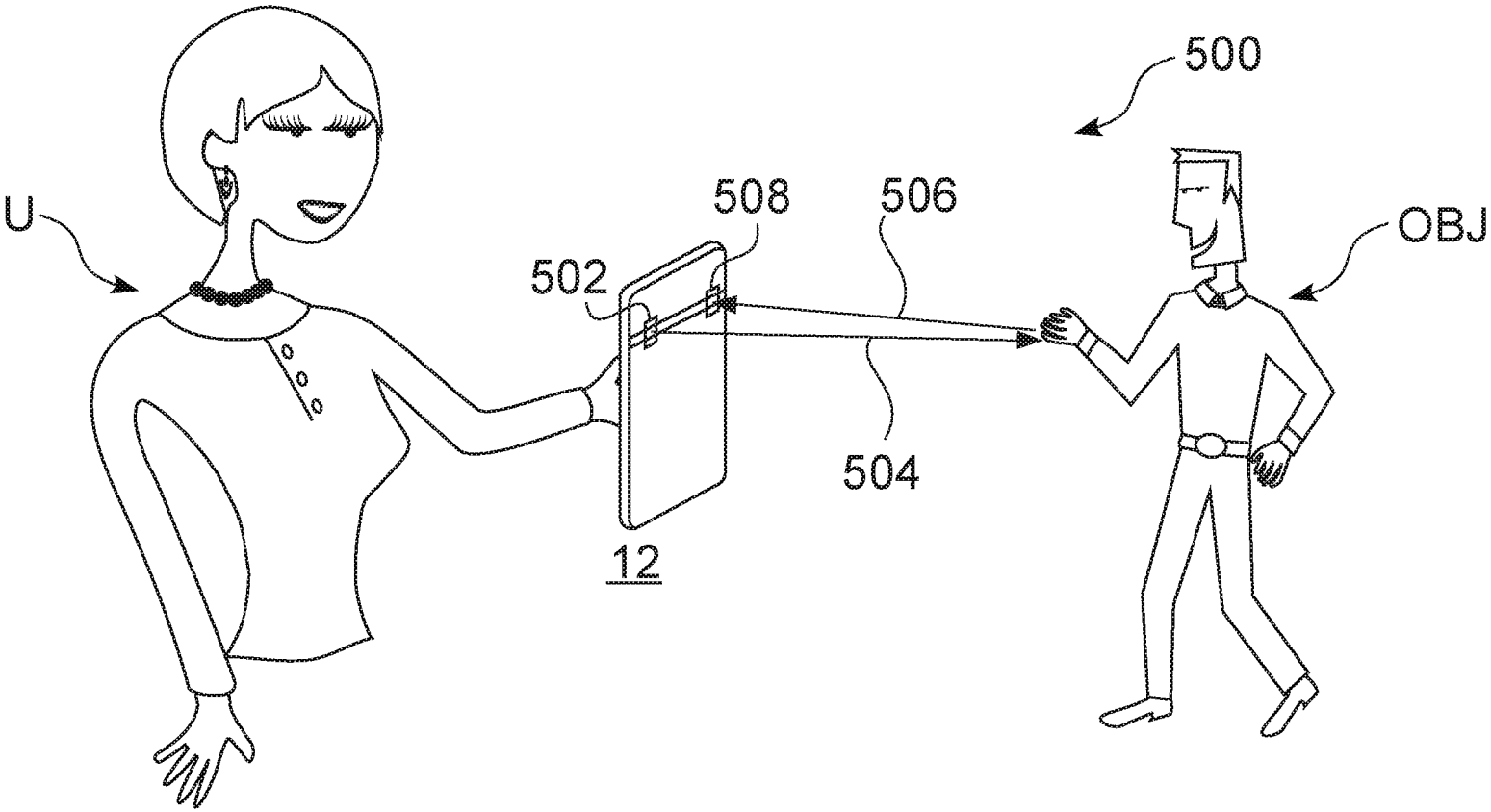
FIG. 14 is a schematic view of a wireless device that is configured to provide providing three-dimensional (3D) sensing through an enhanced antenna break.

FIG. 4 is partial detailed schematic cutaway view 80 of a wireless device 12 having an enhanced antenna break 20 and controlled emission of light 42 based on one or more factors. As seen in FIG. 4, the processor 24, such as in conjunction with a memory 82, can be configured to transmit light 42 through the enhanced antenna break 20 for a wide variety of functions, such as notify the user U (FIG. 14).

For instance, one or more lights 22 can be powered on and off 84 for a variety of purposes, such as for any of a notification, a flash, an accessory light, or to provide a source light for sensing purposes. One or more of the light sources 22 can be colored or can provide one or more colors, e.g., a red green blue (RGB) light emitting diode (LED), such that the processor 24 can be configured to power the light source 22 to emit 86 one or more colors.

In some embodiments, the processor 24 seen in FIG. 4 can controllably power one or more light sources 22 to emit 88 a flashing or other pattern of illumination, or to controllably power one or more light sources 22 based on a priority 90. For instance, a notification that is considered to be a low priority 90 can be powered with any of a low intensity or with a slowly flashing signal, while a notification that is considered to be a high priority 90 can be powered with any of a high intensity or with a rapidly flashing signal.

The operation of one or more light sources 22 can be integrated with a wide variety of system functions and operations. For instance, one or more lights 22 can notify the user U of an incoming call or email, such as in conjunction with or instead of an acoustic or vibrational alarm. As well, the operation of one or more light sources 22 can be integrated with the function of other components, such as to provide one or more flash sources 64 for operation of a camera 62, or to provide an infrared (IR) light source 502 (FIG. 14) to be used in conjunction with an IR sensor 508 (FIG. 14) for three-dimensional sensing of shape, position and/or movement.

As also seen in FIG. 4, one or more light sources 22 can be powered to communicate any of integration 92, the status 94 of other system functions, e.g., power level, memory, wireless reception, time, error status, troubleshooting, or to provide other functions 96, e.g., device-device optical communication, optical control of other components or systems, e.g., entertainment systems, optical thermostat control, gaming, and/or appliance control.

Figure 5:
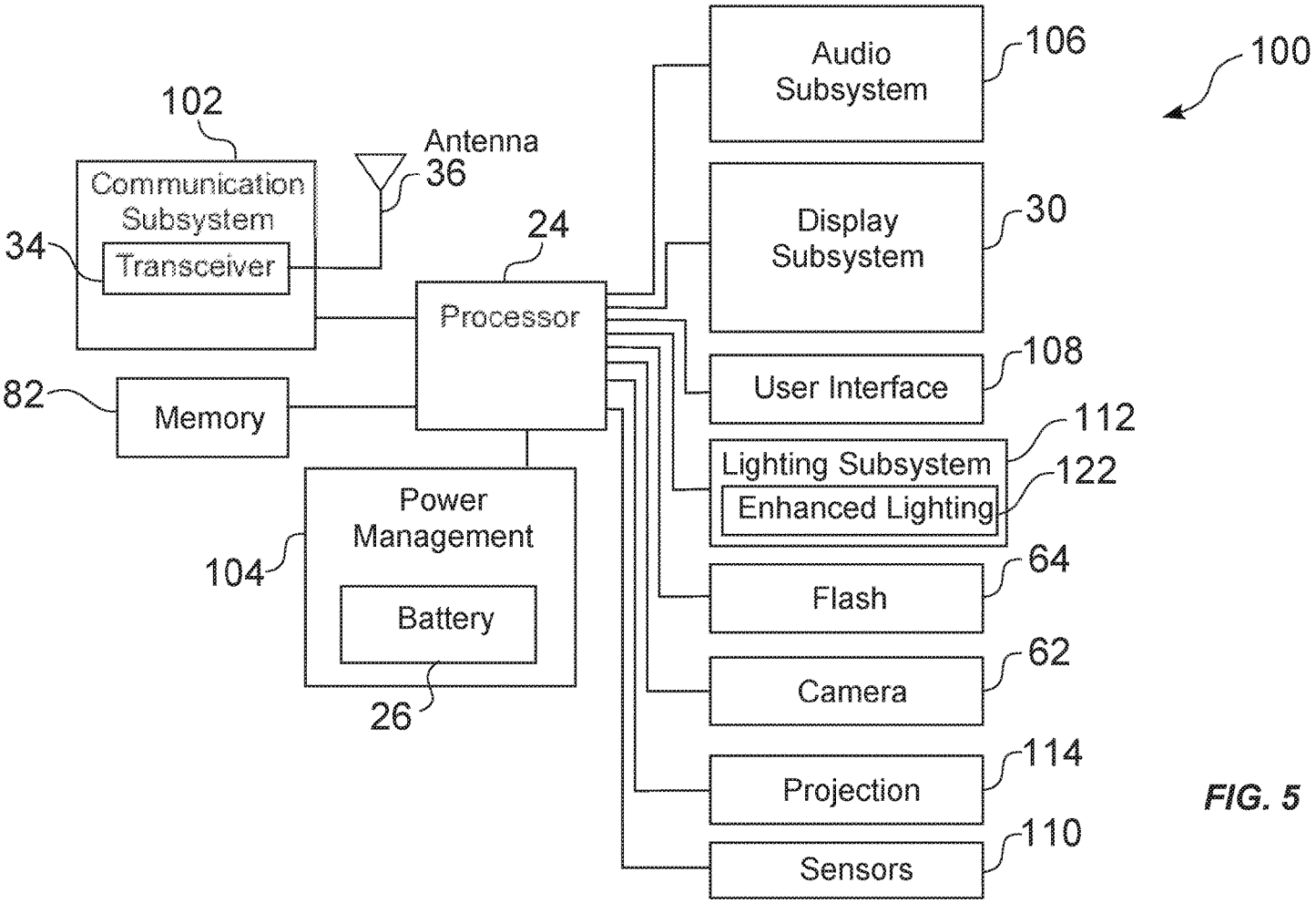
FIG. 5 is an illustrative schematic diagram a wireless device having an enhanced antenna break having controlled passage of light.

FIG. 5 is an illustrative simplified schematic diagram 100 of a wireless device 12 having an enhanced antenna break 20 that allows the passage of light 42. As seen in FIG. 5, a processor 24, such as located on a motherboard, is connected to a memory 82, and to a power management system 104, such as having a battery 26 corresponding thereto. The processor 24 is also connected to a communication subsystem 102, such as including a transceiver 34 and an antenna 36 for the transmission and reception of wireless signals 40. The wireless device 12 seen in FIG. 5 also includes a variety of other components and subsystems, such as an audio subsystem 106, a display subsystem 30, a user interface 108, a lighting subsystem 112 including enhanced lighting 122, a camera 62 and corresponding flash 64, and one or more sensors 110. In some embodiments, the wireless device can include a projection subsystem 114, which in some embodiments can be configured to be transmitted through the antenna break 20.

The implementation of the enhanced antenna break 20 can enable a wide variety of new functions for the wireless device 12, through one or more enhanced lights 22 and/sensors 110, which are configured to send and/or receive light 42 through the antenna break 20.

The use of the antenna break 20 for the communication of optical signals 42 allows a wide variety of light sources 22 and sensors 110 to be used. For instance, while one or more light emitting diodes (LEDs) 22 can be used to transmit light directly outward through the optically transmissive antenna break 20, other light sources 22 and supplementary components can be used. For example, the light source 22 can include one or more laser diodes (LD) 122 (FIGS. 6-8), such as available through Coherent Technologies, of Santa Clara.

Calif. Laser diodes 122 comprise electrically pumped semiconductor lasers, in which the active laser medium is formed by a p-n junction, similar to that of a light emitting diode (LED). In some embodiments, laser diodes 122 can be used for direct illumination through the antenna break 20, such as for scanning bar codes, or for directional lighting.

Figure 6:
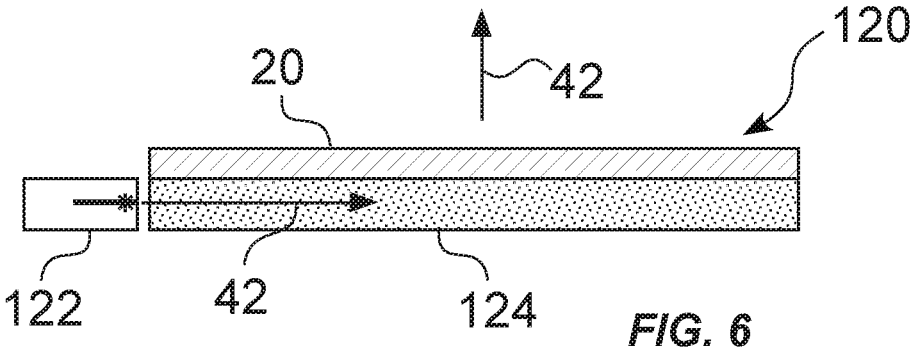
FIG. 6 is a schematic view of an illustrative light source including a laser diode and an optical diffuser for transmission of light output from the laser diode.
Figure 7:
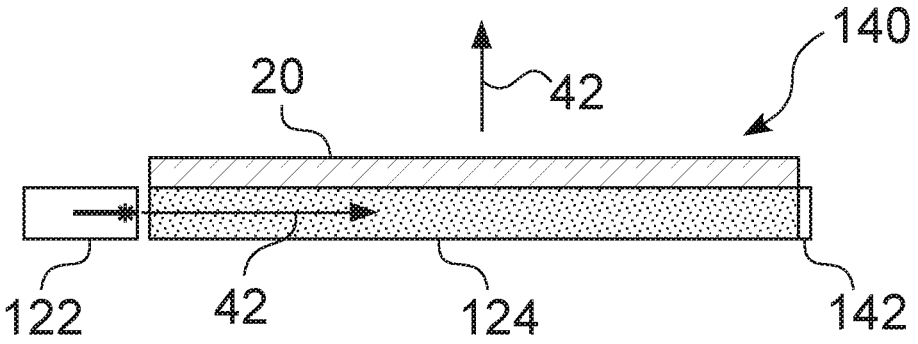
FIG. 7 is a schematic view of an illustrative light source including a laser diode, and optical diffuser having a reflective element, for transmission of light output from the laser diode.
Figure 8:
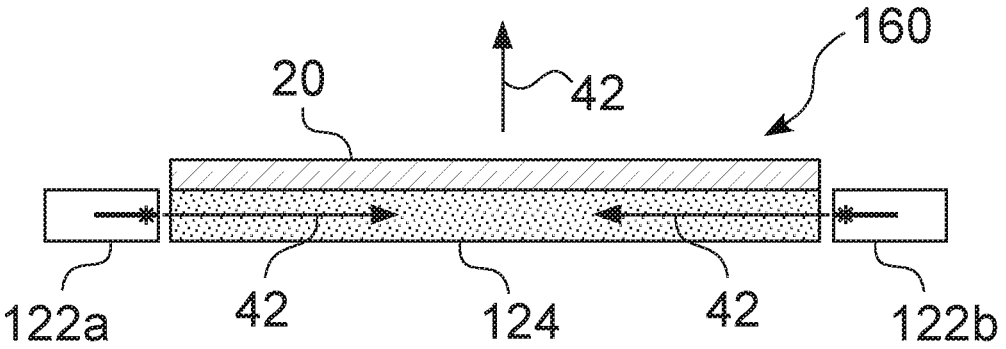
FIG. 8 is a schematic view of an illustrative light source including opposing laser diodes, and an optical diffuser, for transmission of light through the enhanced antenna break.

FIG. 6 is a schematic view 120 of an illustrative light source 22 including a laser diode 122 and an optical diffuser 124 for transmission of light output 42 from the laser diode 122. FIG. 7 is a schematic view 140 of an illustrative light source 22 including a laser diode 122, an optical diffuser 124, and a reflective element 142, for transmission of light 42 from the laser diode 122. FIG. 8 is a schematic view 160 of an illustrative light source 22 including opposing laser diodes 122*a*,122*b*, and an optical diffuser 124 therebetween, for transmission of light 42 through the enhanced antenna break 20. In some embodiments, the optical diffuser 124 is configured as a rigid or flexible light pipe, such as available through Lumex, Inc., of Carol Stream, Ill. In some embodiments, the optical diffuser 124 is a lossy plastic fiber 124.

The optical diffuser 124 seen in FIGS. 6-8 can be used to receive light 42 from the laser diodes 122, wherein incident light 42 can be transmitted therethrough, and is scattered and/or absorbed. For embodiments in which the optical diffuser 124 is mounted proximal to the antenna break 20, the scattered light 42 can then be emitted through the antenna break 20, such as to provide an extended notification light bar 22. The specific scattering and absorption characteristics for the optical diffuser 124 can be chosen based on desired illumination characteristics of the extended notification light bar 22, and the power and thermal requirements for the wireless device 12.

The laser diodes 122 can be driven in a variety of ways, to create a variety of illumination effects. In some embodiments, the laser diodes 122 can be driven with a pulse width modulated (PWM) signal such as to produce illuminated standing or moving wave patterns 184 (FIGS. 9-11) that can be transmitted from the device 12. As seen in FIG. 7 and FIG. 8, other elements, such as a passive element 142, e.g., reflector 142, or an active element 122*b*, e.g., an opposing laser diode 122*b*, can be included to introduce further illumination effects.

Figure 9:
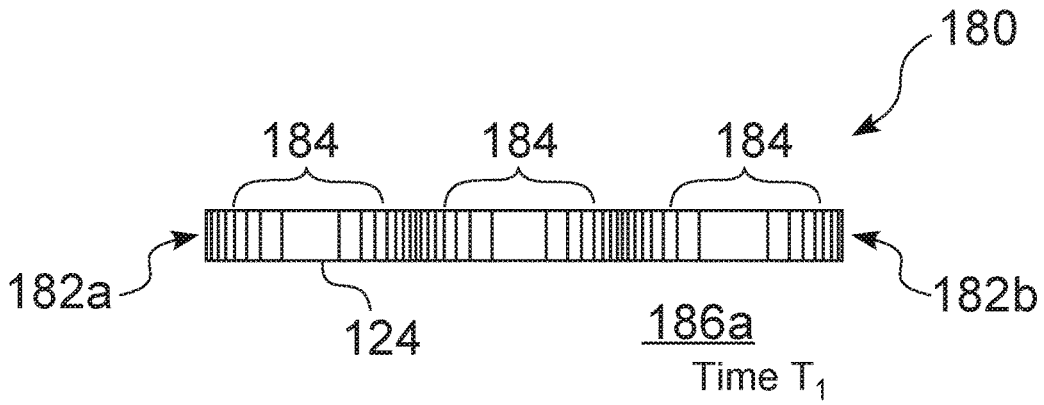
FIG. 9 shows an illustrative output from an optical diffuser through an optically transmissive antenna break at a first time $T_1$.
Figure 10:
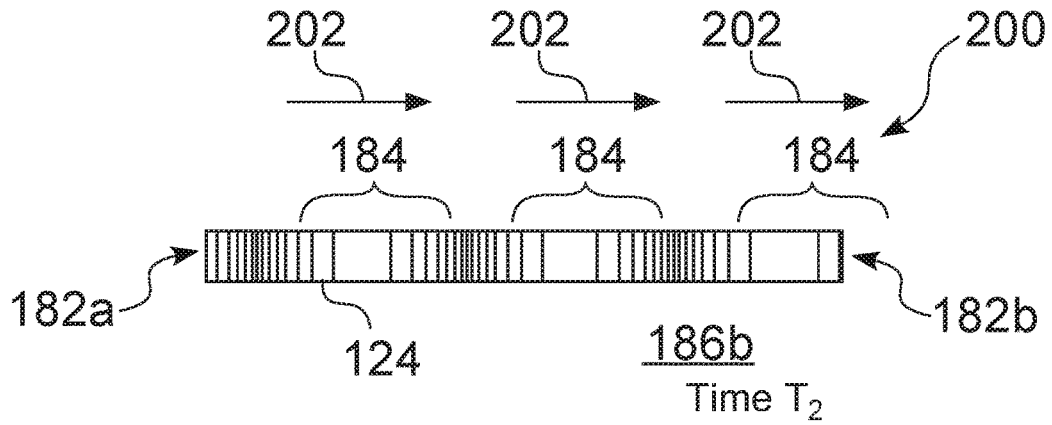
FIG. 10 shows an illustrative output from a an optical diffuser through an optically transmissive antenna break at a second subsequent time $T_2$.
Figure 11:
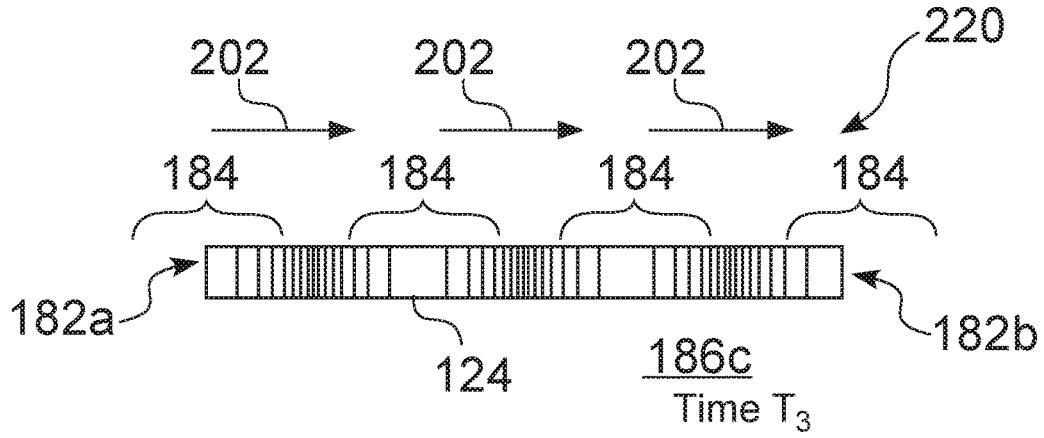
FIG. 11 shows an illustrative output from an optical diffuser through an optically transmissive antenna break at a third subsequent time $T_3$.

FIG. 9 shows an illustrative output 180 from an optical diffuser 124 that extends from a first end 182*a* to a second end 182*b*, through an optically transmissive antenna break 20 at a first time $T_1$186*a*, such as for a laser diode 122 that is driven with a pulse width modulated (PWM) signal to produce standing or traveling waves 184 within an light output signal 42 that is transmitted through the antenna break 20. FIG. 10 shows an illustrative output 200 from an optical diffuser 124 through an optically transmissive antenna break 20 at a second subsequent time $T_2$186*b*, at which time the waves 184 have traveled 202 with respect to their position at $T_1$186*a*. FIG. 11 shows an illustrative output 220 from an optical diffuser 124 through an optically transmissive antenna break at a third subsequent time $T_3$186*c*, at which time the waves 184 have traveled 202 further with respect to their positions at $T_1$ 186*a* and $T_2$186*b*. In some embodiments, the illumination signal 42, such as shown in FIGS. 9-11, can be controlled for any of color, intensity, direction, and shape, depending on their desired optical characteristics.

Figure 12:
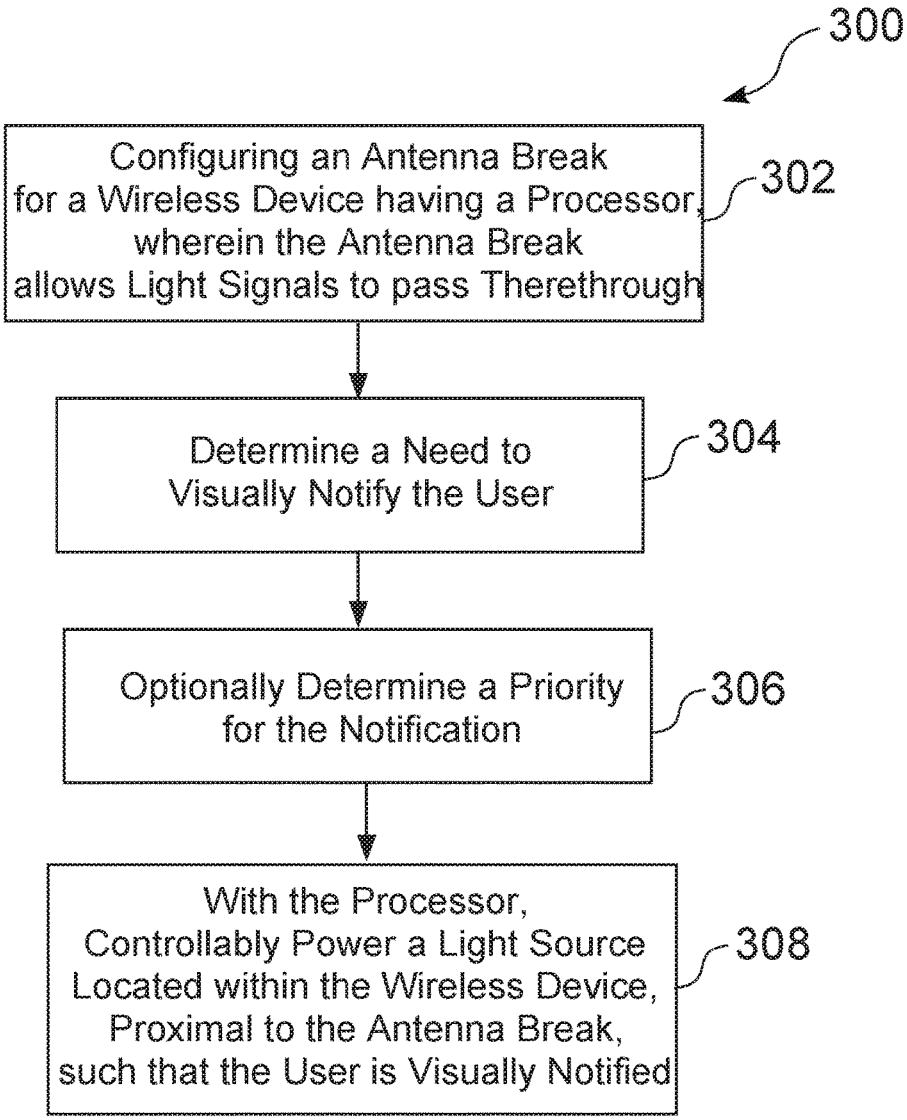
FIG. 12 is a flowchart of an illustrative process for providing a visual notification to a user through an enhanced antenna break.

FIG. 12 is a flowchart of an illustrative process 300 for providing a visual notification for a user U through an enhanced antenna break 20. For instance, upon configuring 302 a suitable antenna break 20 and one or more light sources 22, during operation of the wireless device, a processor 24 can determine 304 a need to visually notify a user U. The priority for the notification can be determined 306, such as by the processor 24 or by the action itself. The processor 24 can then controllably power 308 one or more of the lights sources 22, such as through a driver module, whereby the light signal 42 is produced and transmitted through the antenna break 20 toward the exterior EXT of the wireless device 12.

Figure 13:
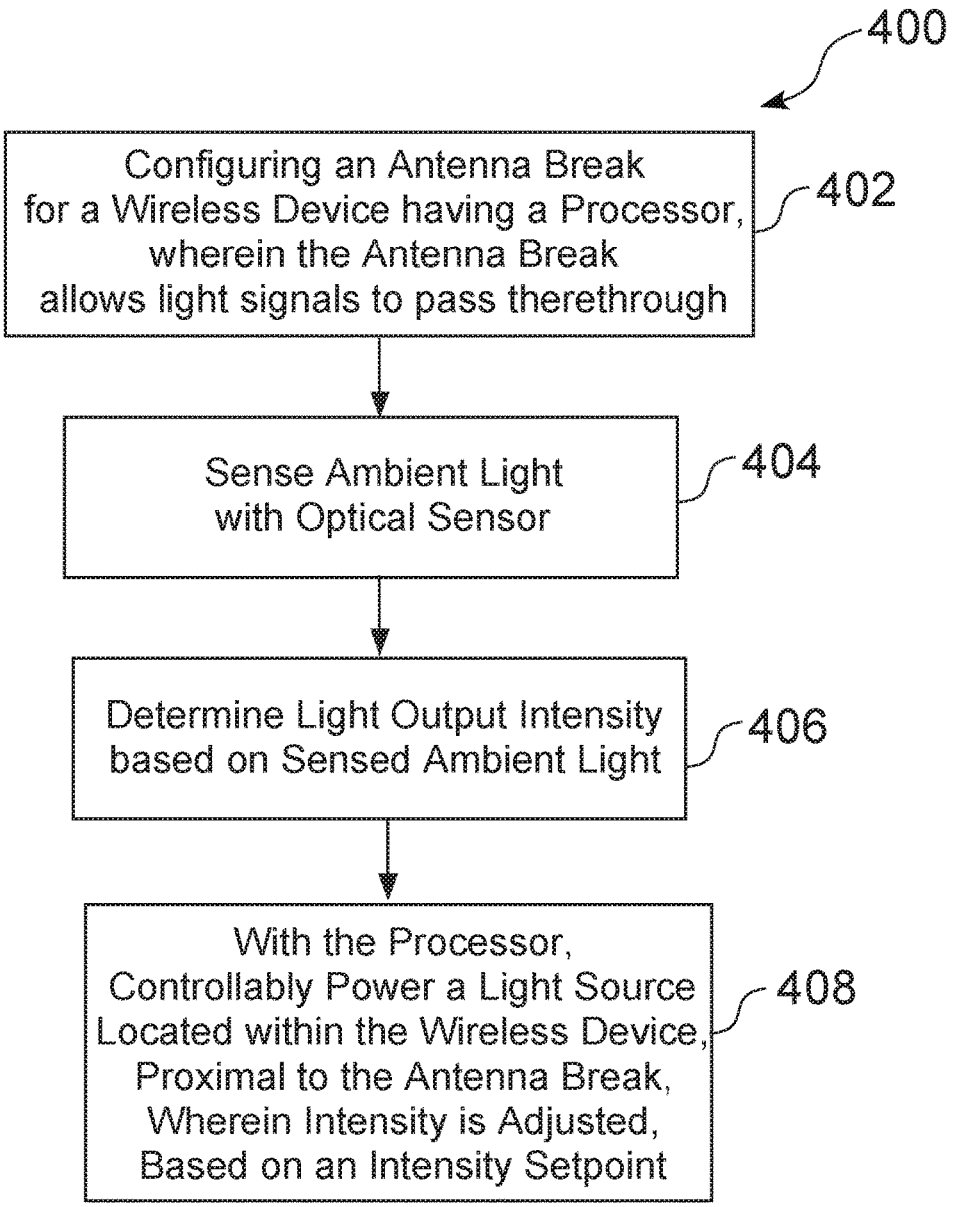
FIG. 13 is a flowchart of an illustrative process for adjusting the intensity of light output through an enhanced antenna break, based on sensing of ambient light.

FIG. 13 is a flowchart of an illustrative process 400 for adjusting the intensity of light 42 output through an enhanced antenna break 20, based on a sensing of ambient light. For a wireless device 12 that is configured 402 with an antenna break 20, which is configured for the transmission of both wireless signals 40, e.g., 40*a*,40*b* (FIG. 1) as well as light 42, the wireless device 12 can include an optical sensor 110 that is configured to receive incoming light 42, wherein the optical sensor 110 can be located to receive the incoming light 42 through the antenna break 20. The wireless device 12 senses 404 the incoming ambient light 42, and the central processor 24 or other corresponding processor can determine 406 a light intensity, such as for the light source 22, based on the sensed 404 ambient light 42. The processor 24, or a processor associated with the light subsystem 112 (FIG. 5), can then control the light intensity of light 42 from a light source 22, or control another component, such as a camera 62, based on the sensed 404 ambient light. For instance, in bright lighting conditions, the intensity of light output can be increased so it can be sensed by the user U, while with dark ambient light, the intensity can be decreased, i.e., dimmed, to a level where the light can still be sensed by the user U, but is not too bright.

Figure 15:
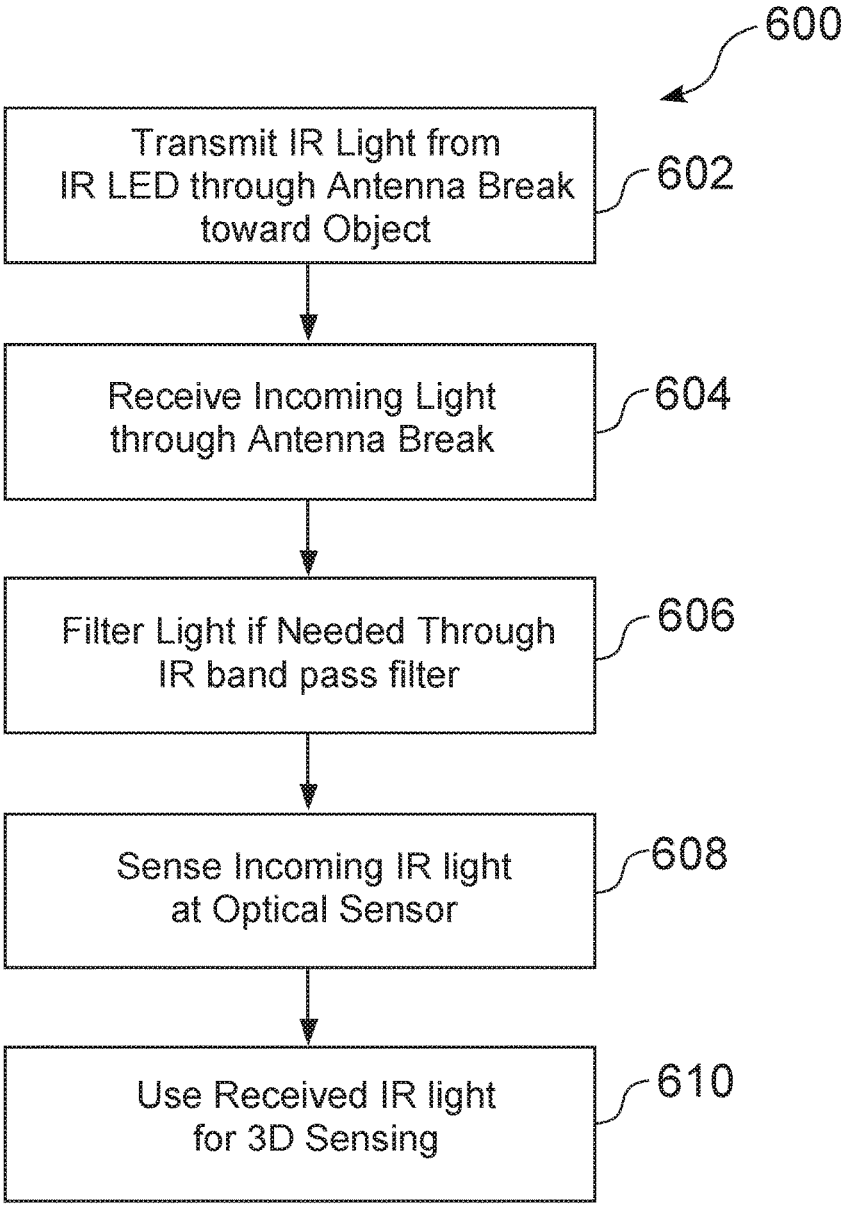
FIG. 15 is a flowchart of an illustrative process for providing three-dimensional (3D) sensing through an enhanced antenna break.

FIG. 14 is a schematic view 500 of a wireless device 12 that is configured to provide providing three-dimensional (3D) sensing 610 (FIG. 15), such as through an enhanced antenna break 20. FIG. 15 is a flowchart of an illustrative process 600 for providing three-dimensional (3D) sensing, such as through an enhanced antenna break 20. As seen in FIG. 14, a user U of a wireless device 12 can sense a 3D position or movement of an object OBJ, such as a person, animal or other object. The illustrative wireless device 12 includes an IR light source 502, which is configured to transmit 602 IR light 504 from the wireless device 12, such as through the antenna break 20. A portion of the IR light 504 is reflected off of one or more parts of the object OBJ, and returns toward the wireless device 12 as reflected IR light 506, in which the reflected IR light 506, as well as other light 42*b* arrives at an optical sensor 508, such as through the antenna break 20. In some embodiments, the arriving light 42, 506 can be filtered 606, such as through an IR band pass filter, wherein the sensor 508 can sense 608 the incoming light 506 from one or more points of the object OBJ, and use the sensed light 506 for 3D sensing 610, such as through the processor 24 or through a processor that is dedicated to the sensing subsystem 110 (FIG. 5).

Figure 16:
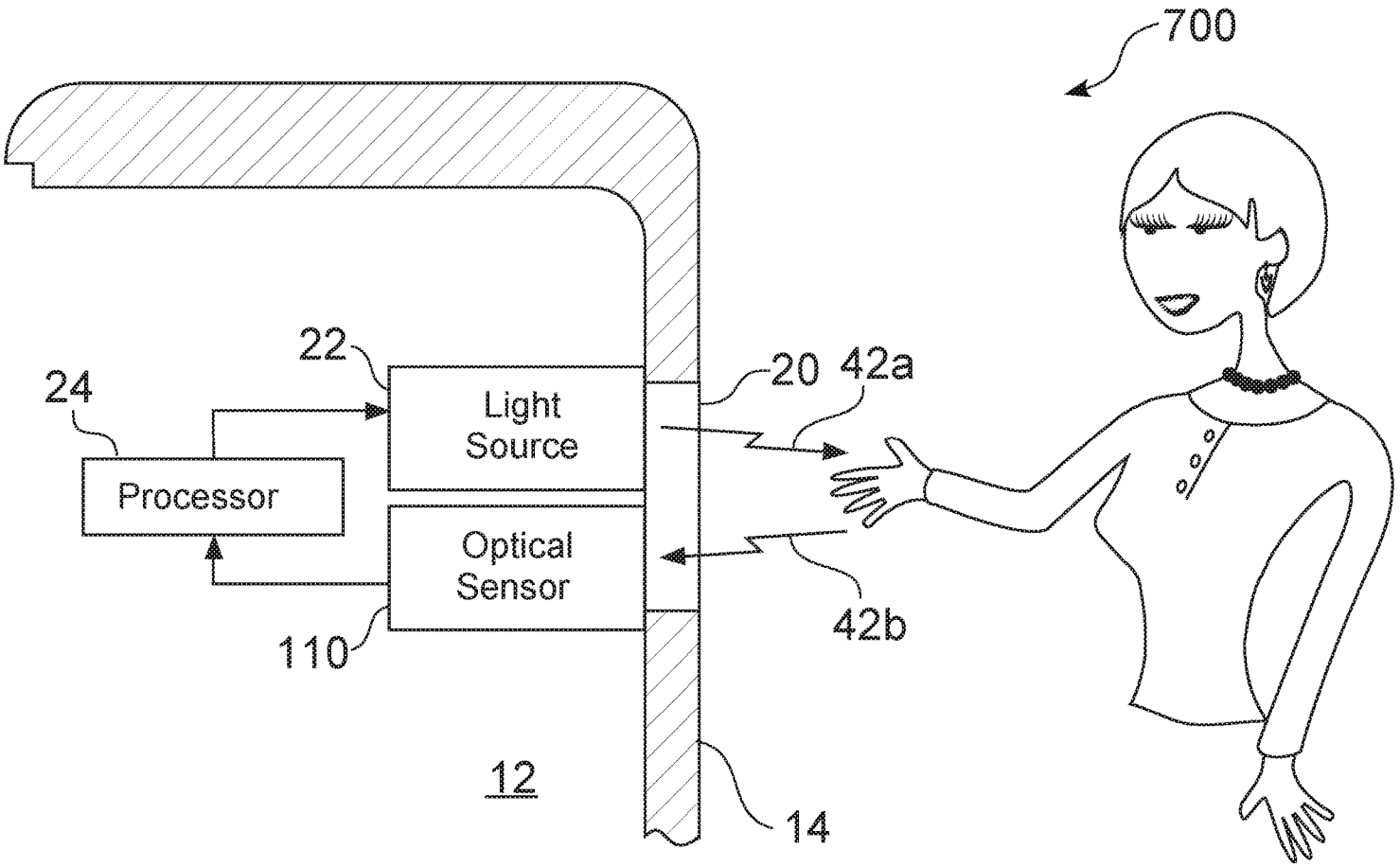
FIG. 16 is a schematic view of a wireless device that is configured to provide user interaction through optical sensing.

FIG. 16 is a schematic view 700 of a wireless device 12 that is configured to provide user interaction through optical sensing. The illustrative device 12 seen in FIG. 16 is configured to transmit an optical signal 42*a* through the antenna break 20, and to sense an incoming optical signal 42*b* through the antenna break 20, such as for direct or indirect interaction with a user U. In some embodiments, the wireless device 12 can provide local control through such optical interaction, such as for power and/or volume. In some embodiments, the wireless device 12 can provide an optical trackpad through such optical interaction. In some embodiments, the wireless device 12 can be configured to provide any of proximity sensing, heart rate sensing, fingerprint sensing, retinal scanning, or temperature scanning.

Figure 17:
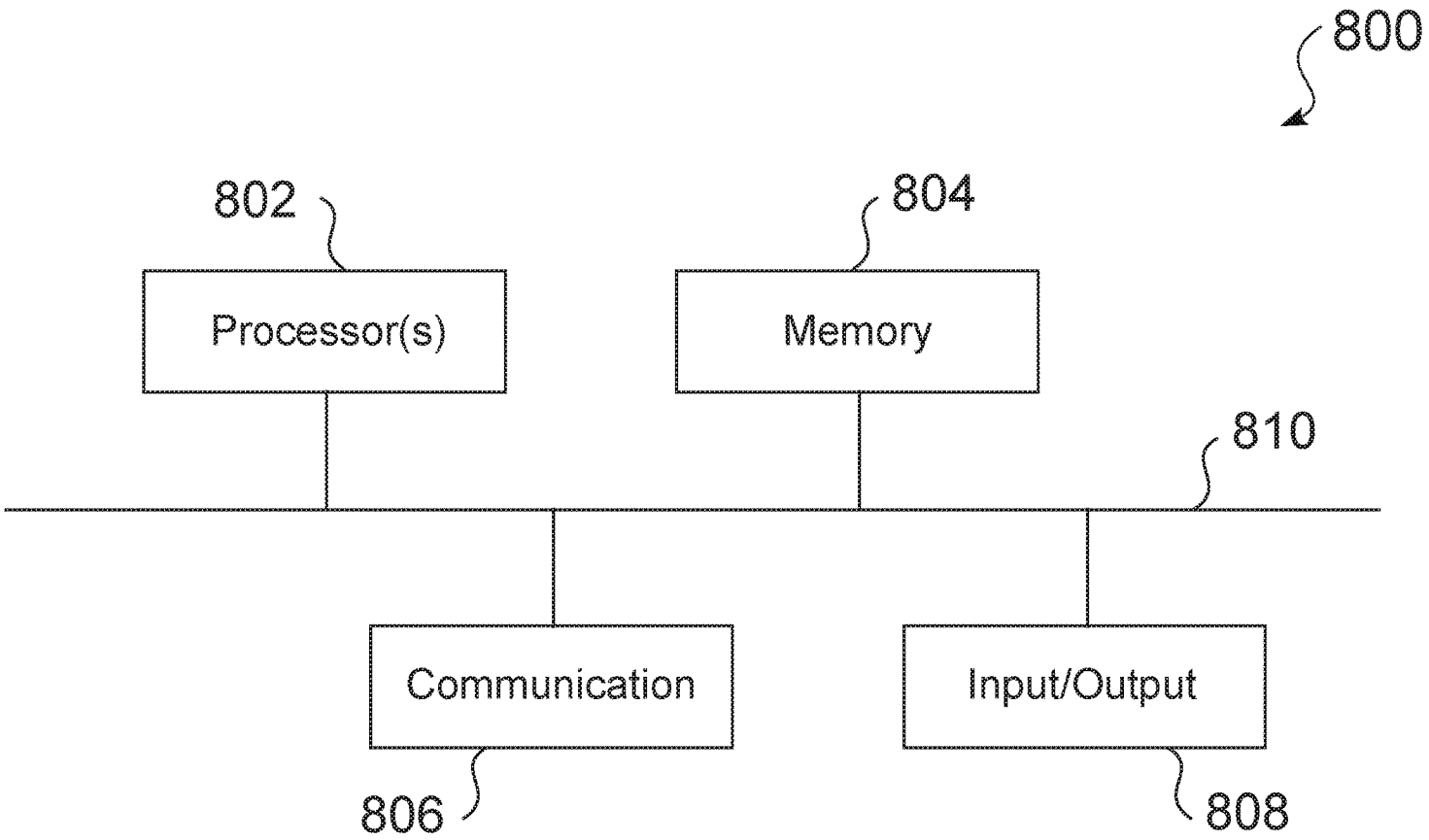
FIG. 17 is a high-level block diagram showing an example of a processing device that can represent any of the systems described herein.

FIG. 17 is a high-level block diagram showing an example of a processing device 800 that can represent any of the wireless devices, and related systems and methods described above. Any of these systems may include two or more processing devices such as represented in FIG. 16, which may be coupled to each other via a network or multiple networks.

In the illustrated embodiment, the processing system 800 includes one or more processors 802, memory 804, a communication device 806, and one or more input/output (I/O) devices 808, all coupled to each other through an interconnect 810. The interconnect 810 may be or include one or more conductive traces, buses, point-to-point connections, controllers, adapters and/or other conventional connection devices. The processor(s) 802, such as the processor 24, may be or include, for example, one or more general-purpose programmable microprocessors, microcontrollers, application specific integrated circuits (ASICs), programmable gate arrays, or the like, or a combination of such devices. The processor(s) 802 control the overall operation of the processing device 800. Memory 804, such as schematically shown as 82 (FIG. 4) may be or include one or more physical storage devices, which may be in the form of random access memory (RAM), read-only memory (ROM) (which may be erasable and programmable), flash memory, miniature hard disk drive, or other suitable type of storage device, or a combination of such devices. Memory 804 may store data and instructions that configure the processor(s) 802 to execute operations in accordance with the techniques described above. The communication device 806 may be or include, for example, an Ethernet adapter, cable modem, Wi-Fi adapter, cellular transceiver, Bluetooth transceiver, or the like, or a combination thereof. Depending on the specific nature and purpose of the processing device 800, the I/O devices 808 can include devices such as a display (which may be a touch screen display), audio speaker, keyboard, mouse or other pointing device, microphone, camera, etc.

Unless contrary to physical possibility, it is envisioned that (i) the methods/steps described above may be performed in any sequence and/or in any combination, and that (ii) the components of respective embodiments may be combined in any manner.

The illumination and/or scanning techniques introduced above can be implemented by programmable circuitry programmed/configured by software and/or firmware, or entirely by special-purpose circuitry, or by a combination of such forms. Such special-purpose circuitry (if any) can be in the form of, for example, one or more application-specific integrated circuits (ASICs), programmable logic devices (PLDs), field-programmable gate arrays (FPGAs), etc.

Software or firmware to implement the techniques introduced here may be stored on a machine-readable storage medium and may be executed by one or more general-purpose or special-purpose programmable microprocessors. A "machine-readable medium", as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible medium includes recordable/non-recordable media, e.g., read-only memory (ROM); random access memory (RAM); magnetic disk storage media; optical storage media; flash memory devices; etc.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described, but can be practiced with modification and alteration within the spirit and scope of the appended claims. Accordingly, the specification, drawings, and attached appendices are to be regarded in an illustrative sense rather than a restrictive sense.

The invention claimed is:

1. An apparatus for a wireless device, wherein the wireless device includes a housing and an interior region defined within the housing, wherein the housing has an exterior surface, and an interior surface opposite the exterior surface, and wherein the wireless device includes an antenna, the apparatus comprising:

a non-metallic antenna break extending between the interior region and the exterior surface of the housing; and a light source located within the interior region proximal to the antenna break;

wherein the antenna break allows passage of wireless signals to or from the antenna; and wherein the antenna break allows light from the light source to be transmitted from the interior region at least to the exterior surface of the housing for any of a display function or a sensing function.

2. The apparatus of claim 1, wherein the light source includes a light emitting diode (LED).

3. The apparatus of claim 2, wherein the LED is a color LED.

4. The apparatus of claim 1, wherein the wireless device includes a processor.

5. The apparatus of claim 4, wherein the light source is configured as a notification bar, and wherein the processor is configured to operate the notification bar for the display function based on a notification output.

6. The apparatus of claim 1, wherein the light source is configured to emit a light signal based on a priority.

7. The apparatus of claim 6, wherein for a high priority, the light signal is emitted with any of an increased periodic frequency or an increased intensity.

8. The apparatus of claim 6, wherein for a low priority, the light signal is emitted with any of a decreased periodic frequency or a decreased intensity.

9. The apparatus of claim 1, wherein the light source includes at least one laser diode.

10. The apparatus of claim 1, wherein the light source is configured to emit a light signal having a sinusoidal intensity.

11. The apparatus of claim 1, wherein the light source includes a laser diode having an output, and an optical diffuser for transmitting the output of the laser diode through the antenna break.

12. The apparatus of claim 1, wherein the light source includes a plurality of light elements.

13. The apparatus of claim 1, further comprising:

a sensor having an output that corresponds to ambient light.

14. The apparatus of claim 13, wherein the intensity of the output of the light source is variable based on the output from the sensor.

15. The apparatus of claim 13, wherein the sensor is located within the interior region of the wireless device, and is configured to receive the ambient light through the antenna break.

16. The apparatus of claim 1, wherein the light source is configured to emit infrared light, the apparatus further comprising:

a sensor that is sensitive to infrared light, wherein the sensor is configured to receive the infrared light emitted from the light source, after being reflected from a target external to the apparatus, wherein the apparatus is configured as a three-dimensional (3D) sensor.

17. An apparatus for a wireless device, wherein the wireless device includes a housing and an interior region defined within the housing, wherein the housing has an exterior surface, and an interior surface opposite the exterior surface, and wherein the wireless device includes an antenna, the apparatus comprising:

an antenna break extending between the interior region and the exterior surface of the housing, wherein the antenna break is configured to promote any of reception or transmission of wireless signals;

a light source located within the interior region proximal to the antenna break; and an optical sensor located within the interior region proximal to the antenna break;

wherein the antenna break allows passage of wireless signals to or from the antenna;

wherein the antenna break allows light from the light source to be transmitted therethrough; and wherein the antenna break allows incoming light to be transmitted therethrough and be received by the optical sensor.

18. The apparatus of claim 17, wherein the light source and the optical sensor are configured for three-dimensional sensing.

19. The apparatus of claim 17, wherein the light source and the optical sensor are configured for user interaction through optical sensing.

20. The apparatus of claim 19, wherein the user interaction includes local control.

21. The apparatus of claim 19, wherein the user interaction includes an optical trackpad.

22. The apparatus of claim 17, wherein the light source and the optical sensor are integrated for any of proximity sensing, heart rate sensing, fingerprint sensing, retinal scanning, or temperature scanning.

23. A process for a wireless device that includes a housing and an interior region defined within the housing, wherein the housing has an exterior surface, and an interior surface opposite the exterior surface, and wherein the wireless device includes a processor and a transceiver having an antenna, the process comprising:

providing a non-metallic antenna break that is optically transmissive between the interior region and the exterior surface, wherein the antenna break allows passage of wireless signals to or from the antenna;

determining a need to visually notify a user of the wireless device; and with the processor, controllably powering a light source located within the interior region proximal to the antenna break, to output a notification signal which is transmitted from the interior region at least to the exterior surface of the housing.

24. The process of claim 23, further comprising:

determining a priority for the notification signal; and modifying the notification signal, based on the determined priority.

25. An apparatus for a wireless device, wherein the wireless device includes a housing and an interior region defined within the housing, wherein the housing has an exterior surface, and an interior surface opposite the exterior surface, and wherein the wireless device includes an antenna, the apparatus comprising:

an antenna break extending between the interior region and the exterior surface of the housing; and a light source located within the interior region proximal to the antenna break;

wherein the antenna break allows passage of wireless signals to or from the antenna; and wherein the antenna break allows light from the light source to be transmitted from the interior region at least to the exterior surface of the housing.

* * * * *